US009744976B2

(12) United States Patent
Wang et al.

(10) Patent No.: US 9,744,976 B2
(45) Date of Patent: Aug. 29, 2017

(54) RAILWAY VEHICLE AND AXLE BOX STRUCTURE THEREOF

(71) Applicant: CRRC QINGDAO SIFANG CO., LTD., Qingdao, Shandong (CN)

(72) Inventors: Peidong Wang, Shandong (CN); Xiaojun Lv, Shandong (CN); Pingyu Zhou, Shandong (CN); Zhenxian Zhang, Shandong (CN); Yingming Li, Shandong (CN); Xiaolong Zou, Shandong (CN); Daqiang Wang, Shandong (CN); Yihui Guan, Shandong (CN)

(73) Assignee: CRRC QINGDAO SIFANG CO., LTD., Qingdao, Shandong (CN)

( * ) Notice: Subject to any disclaimer, the term of this patent is extended or adjusted under 35 U.S.C. 154(b) by 0 days.

(21) Appl. No.: 15/112,513

(22) PCT Filed: Nov. 12, 2015

(86) PCT No.: PCT/CN2015/094415

§ 371 (c)(1),
(2) Date: Jul. 19, 2016

(87) PCT Pub. No.: WO2016/112736

PCT Pub. Date: Jul. 21, 2016

(65) Prior Publication Data

US 2016/0368512 A1 Dec. 22, 2016

(30) Foreign Application Priority Data

Jan. 16, 2015 (CN) ..... 2015 1 0021216
Jan. 16, 2015 (CN) ..... 2015 2 0029771 U

(51) Int. Cl.
*B61F 15/20* (2006.01)
*B61F 5/32* (2006.01)
*B61F 5/28* (2006.01)

(52) U.S. Cl.
CPC ..... *B61F 15/20* (2013.01); *B61F 5/28* (2013.01); *B61F 5/325* (2013.01)

(58) Field of Classification Search
CPC ..... B61F 15/00; B61F 15/02; B61F 15/04; B61F 15/06; B61F 15/12; B61F 15/20;
(Continued)

(56) References Cited

U.S. PATENT DOCUMENTS 1,745,322 A 1/1930 Brittain, Jr.
3,215,384 A 11/1965 Chambers
(Continued)

FOREIGN PATENT DOCUMENTS

CN 200992006 Y 12/2007
CN 201151409 Y 11/2008
(Continued)

OTHER PUBLICATIONS

UK Examination Report for GB1612496.8, mailed Aug. 11, 2016.
International Search Report for PCT/CN2015/094415, mailed Feb. 6, 2016, ISA/CN.

*Primary Examiner* — R. J. McCarry, Jr.
(74) *Attorney, Agent, or Firm* — Yue Xu; U.S. Fairsky LLP

(57) ABSTRACT

A railway vehicle and an axle box structure thereof are provided. The axle box structure includes an axle box body and a positioning joint mounting seat, and a bearing mounting cavity is provided inside the axle box body. The positioning joint mounting seat is provided with a mounting cavity configured to mount a positioning joint, a longitudinal center line of the axle box body is in parallel with a longitudinal center plane of the positioning joint mounting seat, and the longitudinal center plane of the positioning joint mounting seat is outwardly deviated with respect to a longitudinal center plane of the axle box body. In this way, a large space can be left for mounting the brake clamp, and the mounting and replacing of the brake clamp and the wheel set can be facilitated.

9 Claims, 4 Drawing Sheets

(58) Field of Classification Search
CPC .. B61F 15/26; B60G 3/00; B60G 3/02; B60G 9/00; B60G 9/02; B60G 11/00; B60G 11/04; B60G 11/14
See application file for complete search history.

(56) References Cited

U.S. PATENT DOCUMENTS

| | | | | |
|---|---|---|---|---|
| 2004/0123769 | A1* | 7/2004 | Nishimura ..... | B60G 11/14 105/218.2 |
| 2013/0161969 | A1 | 6/2013 | Le Moigne | |

FOREIGN PATENT DOCUMENTS

| | | | |
|---|---|---|---|
| CN | 201193037 | Y | 2/2009 |
| CN | 202180831 | U | 4/2012 |
| CN | 202193087 | U | 4/2012 |
| CN | 103171579 | A | 6/2013 |
| CN | 103174756 | A | 6/2013 |
| CN | 203427804 | U | 2/2014 |
| CN | 103692245 | A | 4/2014 |
| CN | 104608789 | A | 5/2015 |
| CN | 204488815 | U | 7/2015 |
| GB | 1446793 | A | 8/1976 |
| JP | 2006-335138 | A | 12/2006 |

* cited by examiner

RAILWAY VEHICLE AND AXLE BOX STRUCTURE THEREOF

This application is the national phase of International Application No. PCT/CN2015/094415, titled "RAILWAY VEHICLE AND AXLE BOX STRUCTURE THEREOF", filed on Dec. 11, 2015, which claims the benefit of priorities to Chinese Patent Application No. 201510021216.0 titled "RAILWAY VEHICLE AND AXLE BOX STRUCTURE THEREOF", filed with the Chinese State Intellectual Property Office on Jan. 16, 2015, and Chinese Patent Application No. 201520029771.3 titled "RAILWAY VEHICLE AND AXLE BOX STRUCTURE THEREOF", filed with the Chinese State Intellectual Property Office on Jan. 16, 2015, the entire disclosures of which applications are incorporated herein by reference.

FIELD

The present application relates to the technical field of railway vehicles, and particularly to a railway vehicle and an axle box structure thereof.

BACKGROUND

An axle box structure is a movable joint by which a frame is connected to a wheel set, in addition to transmitting forces and vibrations in all directions, the axle box structure must ensure that the wheel set is capable of adapting to line conditions to jump up and down and move left and right with respect to the frame.

As an important part connecting the wheel set and the frame, the axle box structure generally includes a rocker arm type structure and a tension bar type structure. Currently, most railway vehicles employ the rocker arm type axle box structure, which includes an axle box and a rocker arm integrated with each other, that is, a rocker arm type axle box. The rocker arm type axle box includes an axle box body and a positioning joint mounting seat, a bearing is provided inside the axle box body, and the end of an axle is arranged inside the axle box through the bearing. An axle box spring is provided between an upper end surface of the axle box body and a bogie frame. A vertical damper mounting seat configured to mount one end of the vertical damper is further provided on an outer wall of the axle box body, and another end of the vertical damper is connected to the bogie frame. The positioning joint mounting seat is configured to install a positioning joint, and the positioning joint is configured to transmit a tractive force and a braking force between the wheel set and the bogie frame.

Currently, a brake disc is further mounted on the axle at a position close to an inner side of the wheel set, and a brake clamp for braking the brake disc is further mounted on the frame. The wheel set and the brake disc are required to be removed and replaced quickly from the axle in the later use process. The rocker arm type axle box described above is mounted on an outer side of the wheel set, that is, parts and components installed close to the wheel set are numerous, but due to a limited space under the vehicle, components such as the rocker arm type axle box, the brake disc, and the brake clamp can only be arranged in a limited space, that is, structures of the components described above directly affect the assembly relationships between the components, and even adversely affect performance of the whole vehicle. Therefore, an object to be pursued constantly by those skilled in the art is to optimize the position relationships between the rocker arm type axle box, the brake disc and the brake clamp.

Therefore, a technical issue to be addressed presently by those skilled in the art is to optimize the arrangement of components under vehicle such as the rocker arm axle box, the brake disk, the brake clamp on the vehicle body, optimize the whole vehicle layout, and improve a speed of replacing the wheel set according to the current state of the vehicle body.

SUMMARY

An object of the present application is to provide a railway vehicle and an axle box structure, by changing the specific structure of the axle box structure, the arrangement of components under the vehicle is further optimized, and the braking reliability of the whole vehicle may be improved and the speed of replacing a wheel set may also be increased.

An axle box structure for a railway vehicle is provided according to the present application, which includes an axle box body and a positioning joint mounting seat, a bearing mounting cavity is provided inside the axle box body, the positioning joint mounting seat is provided with a mounting cavity configured to mount a positioning joint, a longitudinal center line of the axle box body is in parallel with a longitudinal center plane of the positioning joint mounting seat, and the longitudinal center plane of the positioning joint mounting seat is outwardly deviated with respect to a longitudinal center plane of the axle box body.

Herein, assembly position relationships between an axle, a bogie frame, a wheel set, and a brake clamp are further optimized, and specifically the longitudinal center plane of the positioning joint mounting seat is deviated outwardly with respect to the longitudinal center plane of the axle box body. Accordingly, an axial center of a spring case fixed to the bogie frame is not coincident with the center of a side beam configured to fix the positioning joint in the bogie frame. In this way, a large space can be left for mounting the brake clamp, and the mounting and replacing of the brake clamp and the wheel set can be facilitated. Apparently, compared with the conventional technology, the structure optimized herein may have a larger utilizable space for the mounting position of the brake clamp, which facilitates the mounting of the brake clamp with a relatively larger volume, and improves the brake capacity, and thus improving the performance of the whole vehicle.

In addition, a mounting position of the positioning joint is also close to an outer side, which facilitates the mounting and dismounting operations.

Preferably, the axle box body has a separated structure, which includes an upper box body and a lower box body which are in a seal fit with each other, the upper box body and the lower box body enclose to form the bearing mounting cavity, the upper box body and the lower box body are connected by bolting, and the positioning joint mounting seat is integrally formed with the upper box body.

Preferably, a lower end surface of the upper box body has a convex portion extending downwardly at each of two outer lateral edges in an axial direction, an upper end surface of the lower box body has a concave portion concaved downwardly at each of two outer lateral edges in the axial direction, and center portions of the upper box body and the lower box body are respectively provided with a first semi-circular hole and a second semi-circular hole. After the convex portion and the concave portion are assembled by covering and sealing, the bearing mounting cavity is formed by the first semi-circular hole and the second semi-circular hole.

Preferably, the convex portion further has a first boss extending outwardly, the concave portion has a second boss extending outwardly, the first boss is provided with an internal threaded hole, and the second boss is provided with a through hole. The upper box body and the lower box body are fixedly connected to each other by a bolt arranged inside both the through hole and the internal threaded hole.

Preferably, in the axial direction, each of two ends of the first boss has an extension portion extending outwardly, and each of the two extension portions is provided with a vertical damper mounting seat mounted fitting a vertical damper of the railway vehicle.

Preferably, the axle box structure for the railway vehicle further includes a positioning pin, the positioning pin includes a large diameter section at a middle portion and small diameter sections located at two ends of the large diameter section respectively, and a countersink is further provided in an upper end surface of the second boss. A height of the large diameter section is smaller than a height of a large hole of the countersink, a positioning hole is also provided at a matching position in a lower end surface of the first boss, and the two small diameter sections are respectively arranged inside a small hole of the countersink and the positioning hole after the upper box body fits the lower box body.

Preferably, a wheel set hanger bracket is further provided on an outer wall of the upper box body, and the wheel set hanger bracket is provided with a vertical hanging hole. A rail guard mounting seat configured to mount and fix a rail guard of the railway vehicle is further provided at the bottom of an outer wall of the lower box body.

Preferably, a first drainage groove and a second drainage groove are provided in a circumferential direction of ends of end covers of the upper box body and the lower box body respectively, and the first drainage groove and the second drainage groove form an annular groove after the upper box body and the lower box body are assembled.

Preferably, the positioning joint mounting seat has a separated structure, which includes a left mounting seat and a right mounting seat. The left mounting seat is integrally formed with the upper box body, and each of the left mounting seat and the right mounting seat has an inwardly recessed portion. After the left mounting seat and the right mounting seat are matched and fixed, the two recessed portions form the mounting cavity for the positioning joint.

A railway vehicle is further provided according to the present application, which includes a wheel set, a frame, and an axle box structure mounted between the wheel set and the frame, the axle box structure is the axle box structure according to any one of the above aspects, and the frame is provided with a side beam configured to fit the positioning joint.

Since the railway vehicle has the above axle box structure, the railway vehicle also has the above technical effects of the axle box structure.

Figure 1:
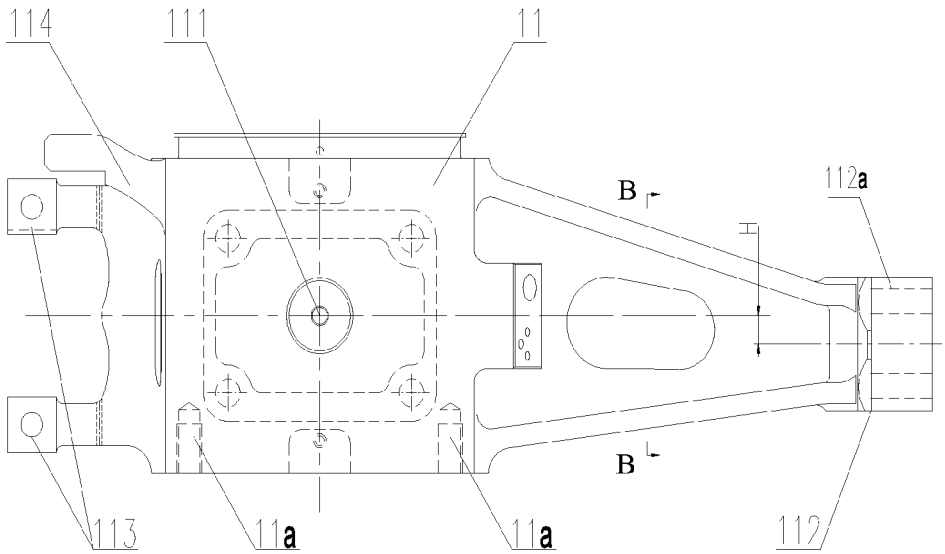
FIG. 1 is a schematic view showing the structure of an axle box structure according to an embodiment of the present application.

In the drawings, one-to-one correspondences between components and reference numerals in FIGS. 1 to 5 are as follows:

| | | | |
|---|---|---|---|
| 11 | upper box body, | 1a | bearing mounting cavity, |
| 11a | threaded hole, | 11c | first drainage groove, |
| 12c | second drainage groove, | 111 | spring mounting seat, |
| 111 | a threaded hole, | 112 | positioning joint mounting seat, |
| 112a | mounting hole, | 113 | vertical damper mounting seat, |
| 114 | wheel set hanger bracket, | 115a | threaded hole, |
| 116 | convex portion, | 115 | first boss, |
| 122 | second boss, | 12 | lower box body, |
| 12b | oil drainage hole, | 121 | rail guard mounting seat, |
| 122 | boss, | 122a | through hole, |
| 123 | concave portion, | 13 | rocker, |
| 114 | positioning pin, | 141 | large diameter section, |
| 142 | first small diameter section, and | 143 | second small diameter section. |

DETAILED DESCRIPTION

A core of the present application is to provide a railway vehicle and an axle box structure. By changing the specific structure of the axle box structure, the arrangement of components under the vehicle is further optimized, and the braking reliability of the whole vehicle may be improved, and the speed of replacing a wheel set may be increased.

For those skilled in the art to better understand the solutions of the present application, the present application is further described in detail in conjunction with drawings and embodiments hereinafter.

Figure 2:
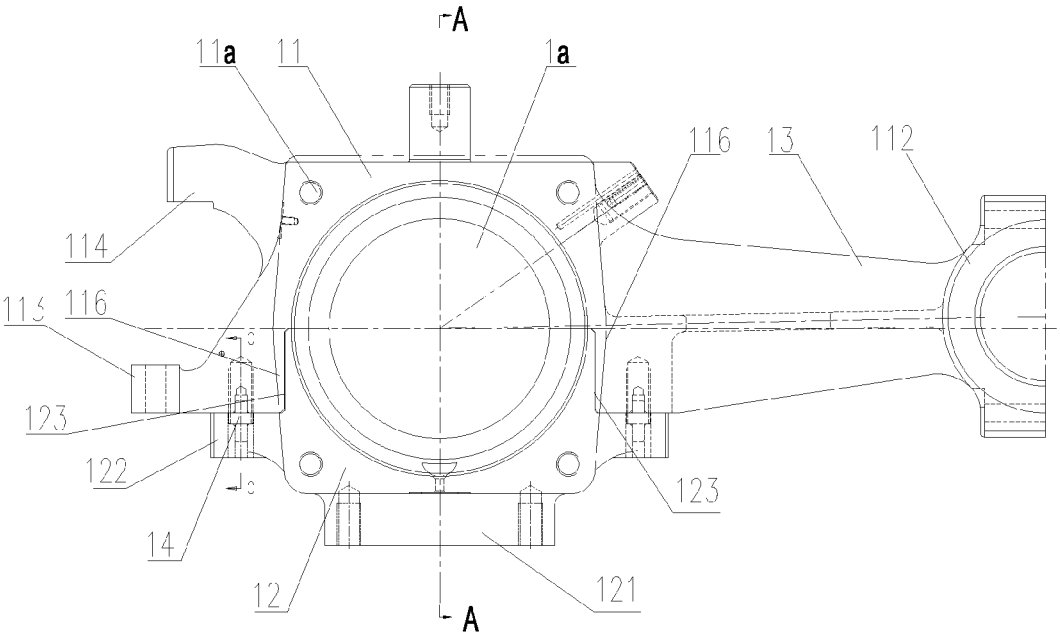
FIG. 2 is a top view of the axle box structure in FIG. 1.

Reference is made to FIGS. 1 to 2, FIG. 1 is a schematic view showing the structure of an axle box structure according to an embodiment of the present application; and FIG. 2 is a top view of the axle box structure in FIG. 1.

An axle box structure for a railway vehicle is provided according to the present application, which includes an axle box body and a positioning joint mounting seat 112. A bearing mounting cavity 1*a* is provided inside the axle box body, a bearing is mounted inside the bearing mounting cavity 1*a*,and an end portion of an axle provided with a wheel set is arranged inside the bearing mounting cavity 1*a* of the axle box body via the bearing. In order to protect the inside bearing from being adversely affected by an external environment, a front end cover and a rear end cover are further provided respectively on two sides of the bearing mounting cavity 1*a* of the axle box body. An axle box spring mounting seat 111 configured to mount an axle box spring is further provided on an upper end surface of the axle box body. Accordingly, a frame is provided with a spring case, and the axle box spring is arranged in the spring case. Generally, the axle box spring mounting seat 111 is provided with a threaded hole 111*a* which is configured to fix the spring case.

The positioning joint mounting seat 112 is provided with a mounting cavity for mounting a positioning joint, and the positioning joint is configured to transmit a tractive force and a braking force between the wheel set and the frame. Generally, a brake disk is further mounted on the axle at a position close to an inner side of the wheel set, and a brake clamp for braking the brake disc is further mounted on the frame. In the present application, a longitudinal center line of the axle box body is in parallel with a longitudinal center plane of the positioning joint mounting seat 112. Further, the longitudinal center plane of the positioning joint mounting seat 112 is deviated outwardly with respect to a longitudinal center plane of the axle box body. A deviation distance H may be chosen according to designs, preferably, the deviation distance H ranges from 10 mm to 30 mm, and more preferably, is 20 mm. Accordingly, a side beam on the frame configured to connect the positioning joint is also deviated outwardly by an appropriate distance.

Herein, assembly positions between the axle, the bogie frame, the wheel set, and the brake clamp are further optimized, and specifically the longitudinal center plane of the positioning joint mounting seat 112 is deviated outwardly with respect to the longitudinal center plane of the axle box body. Accordingly, an axial center of the spring case provided on the frame is not coincident with the center of the side beam on the frame configured to fix the positioning joint, thus leaving a large space for mounting the brake clamp, and facilitating mounting and replacing of the brake clamp and the wheel set. Apparently, compared with the conventional technology, the structure optimized herein may allow the mounting position of the brake clamp to have a large utilizable space, which facilitates the mounting of the brake clamp with a relatively large volume, and improves the brake capacity, thereby improving the performance of the whole vehicle.

In addition, a mounting position of the positioning joint is also close to an outer side, thus facilitates the mounting and dismounting operations.

For further facilitating the replacement of the wheel set, in a specific embodiment, the axle box body may further be of a separated structure, which includes an upper box body 11 and a lower box body 12 which are in a seal fit with each other. The upper box body 11 and the lower box body 12 enclose to form the bearing mounting cavity la, and the upper box body 11 and the lower box body 12 are connected by bolting. The positioning joint mounting seat 112 and the upper box body 11 are integrally formed.

In this way, in case of replacing the wheel set, the replacing of the wheel set may be achieved by simply removing the lower box body 12 from the upper box body 11 and removing related components connected to the lower box body 12, thus there is no need to disassemble the whole axle box body, thereby greatly improving the efficiency of replacing the wheel set.

The specific connection structure of the upper box body 11 and the lower box body 12 may be achieved by various implementations. Specific structures of the upper box body 11 and the lower box body 12 are as follows.

Figure 3:
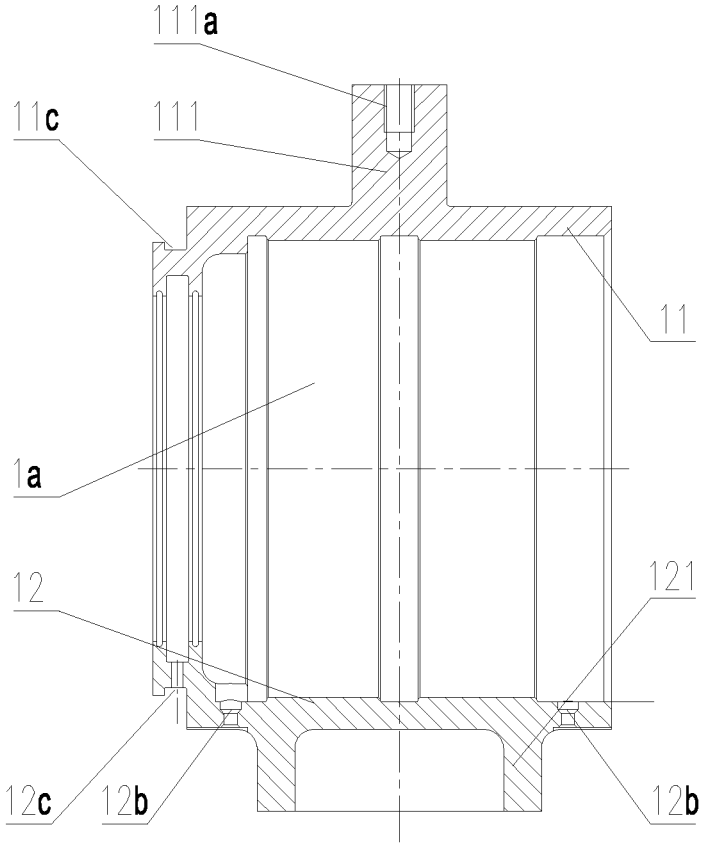
FIG. 3 is a view taken along line A-A in FIG. 2.

Reference is made to FIG. 3, which is a view taken along line A-A in FIG. 2. In a specific embodiment, a convex portion 116 extending downwardly is provided on a lower end surface of the upper box body 11 at each of two outer lateral edges in an axial direction, and a concave portion 123 concaved downwardly is provided on an upper end surface of the lower box body 12 at each of two outer lateral edges in the axial direction. Center portions of the upper box body 11 and the lower box body 12 are respectively provided with a first semi-circular hole and a second semi-circular hole. After the convex portion 116 and the concave portion 123 are assembled by covering and sealing, the bearing mounting cavity 1*a* is formed by the first semi-circular hole and the second semi-circular hole. It should be noted that, the axial direction mentioned above refers to the direction of an axis of the axle when the axle box body and the wheel set are in the assembled position.

A sealing ring and other components may be provided between the upper box body 11 and the lower box body 12 to achieve the covering and sealing assembly, and such an assembly method is advantageous for improving the sealing performance of the bearing mounting cavity 1*a*. A labyrinth sealing structure and a clearance sealing structure may be both provided inside the upper box body 11 and the lower box body 12 to ensure the sealing performance.

Figure 4:
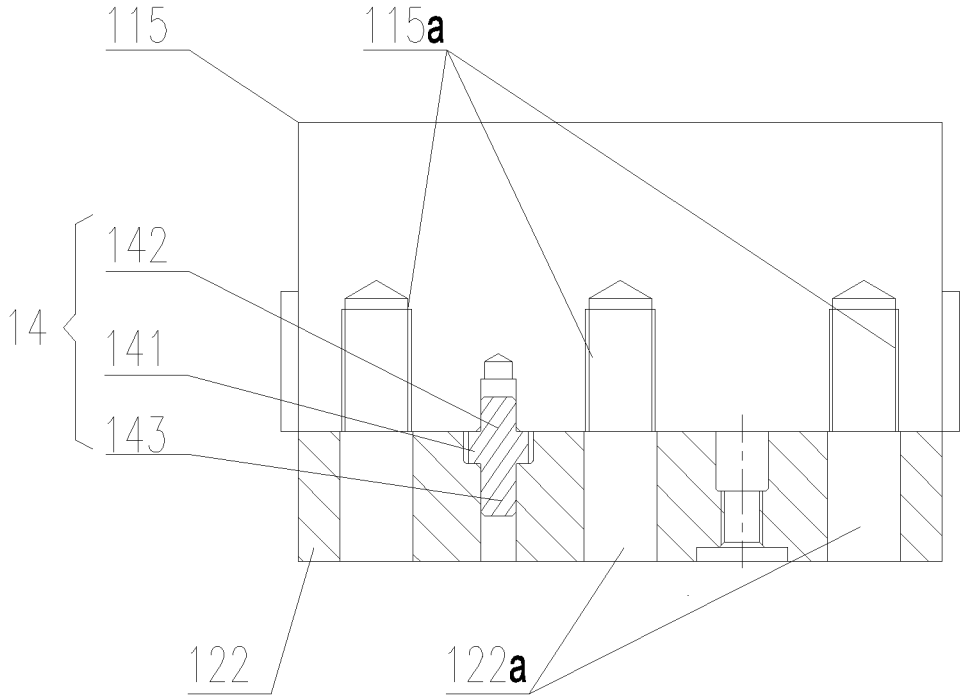
FIG. 4 is a view taken along line C-C in FIG. 2.

Reference is made to FIG. 4, which is a view taken along line C-C in FIG. 2.

Specifically, the convex portion 122 may further have a first boss 115 extending outwardly, and the concave portion 123 has a second boss 122 extending outwardly. The first boss 115 is provided with an internal threaded hole 115*a*,and the second boss 122 is provided with a through hole 122*a*. The upper box body 11 is fixedly connected to the lower box body 12 by a bolt arranged inside both the through hole 122*a* and the internal threaded hole 115*a*. To fix the axle box body of such a structure, a threaded portion of a screw or of a bolt, from down to up, passes through the through hole 122*a* of the second boss 122 and is screwed into the internal threaded hole 115*a* of the first boss 115, thereby realizing the reliable fixation of the first boss 115 and the second boss 122.

In a specific embodiment, in the axial direction, each of two ends of the first boss 115 has an extension portion extending outwardly, each of the two extension portions is provided with a vertical damper mounting seat 113 fitting a vertical damper of the railway vehicle. In this embodiment, the vertical damper mounting seat 113 is integrally formed with the upper box body 11 without subsequent assembly, which not only can simplify the machining processes of the axle box body, but also can improve the use intensity of the axle box body.

For easily assembling the upper box body 11 and the lower box body 12, the axle box structure in the above embodiments may further includes a positioning pin 114, the positioning pin 114 includes a large diameter section 141 at a middle portion, and small diameter sections located at two ends of the large diameter section 141. A countersink is further provided in an upper end surface of the second boss 122, the countersink includes a large diameter hole having a larger diameter and a small diameter hole having a smaller diameter, and a height of the large diameter section 141 is smaller than a height of the large diameter hole of the countersink. A positioning hole is provided at a matching position in a lower end surface of the first boss 115. When the upper box body 11 and the lower box body 12 are assembled, two small diameter sections are respectively arranged inside the small diameter hole of the countersink and the positioning hole. Herein, the two small diameter sections are defined as a first small diameter section 142 and a second small diameter section 143. The first small diameter section 142 and the second small diameter section 143 respectively fit the positioning hole of the first boss 115 and the small diameter hole of the countersink, and the fit there between may be a clearance fit or an interference fit.

In this way, when the upper box body 11 and the lower box body 12 are mounted, firstly the second small diameter section 143 of the positioning pin 114 is arranged inside the small diameter hole of the countersink of the second boss 122, which may achieve a quick and accurate positioning of the upper box body 11 and the lower box body 12, and then the upper box body 11 and the lower box body 12 are fixed to each other by bolting.

In the above embodiments, a wheel set hanger bracket may be further provided on an outer wall of the upper box body 11, and the wheel set hanger bracket is provided with a vertical hanging hole. A rail guard mounting seat 121 configured to mount and fix a rail guard of the railway vehicle is further provided at the bottom of an outer wall of the lower box body 12, and a specific structure thereof is shown in FIG. 3.

Figure 5:
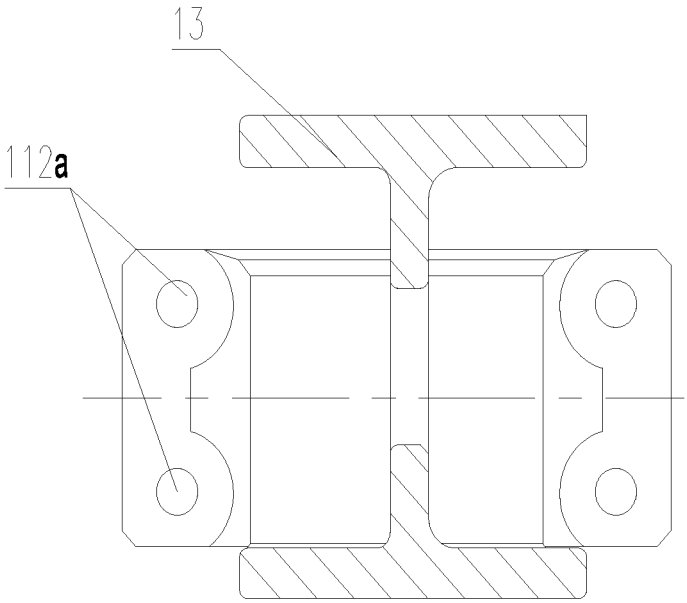
FIG. 5 is a view taken along line B-B in FIG. 1.

Reference is made to FIG. 5, which is a view taken along line B-B in FIG. 2. Only a left mounting seat is shown in FIGS. 1 and 2, and a right mounting seat is not shown.

Further, for facilitating quick removing of the positioning joint, the positioning joint mounting seat 112 may be of a separated structure, which includes the left mounting seat and the right mounting seat, the left mounting seat is integrally formed with the upper box body 11, and each of the left mounting seat and the right mounting seat has an inwardly recessed portion. After the left mounting seat and the right mounting seat are matched and fixed to each other, the two recessed portions form a mounting cavity for the positioning joint. The left and right mounting seats are connected by bolting, and the specific arrangement of a mounting hole 112*a* of the left mounting seat is shown in FIG. 5.

In the above embodiments, a first drainage groove 11*c* and a second drainage groove 12*c* are respectively provided in a circumferential direction of ends of end covers of the upper box body 11 and the lower box body 12. After the upper box body 11 and the lower box body 12 are mounted, the first drainage groove 11*c* and the second drainage groove 12*c* form an annular groove. Such an arrangement may prevent water and other liquids from directly entering into the axle box body.

The lower box body 12 is further provided with an oil drainage hole 12*b*,via which, testing oil, bearing grease and the like can be discharged without disassembling other components, thereby improving the operating efficiency.

Based on the above axle box structure, a railway vehicle is further provided herein, which includes a wheel set, a frame, and an axle box structure mounted between the wheel set and the frame, and the axle box structure is the axle box structure according to any one of the above embodiments.

Since the railway vehicle has the above axle box structure, the railway vehicle also has the above technical effects of the axle box structure.

A railway vehicle and the axle box structure of the railway vehicle according to the present application are described in detail hereinbefore. The principle and the embodiments of the present application are illustrated herein by specific examples. The above description of examples is only intended to help the understanding of the method and the spirit of the present application. It should be noted that, for those skilled in the art, a few of modifications and improvements may be made to the present application without departing from the principle of the present application, and these modifications and improvements are also deemed to fall into the scope of the present application defined by the claims.

What is claimed is:

1. An axle box structure for a railway vehicle, comprising an axle box body, and a positioning joint mounting seat, wherein a bearing mounting cavity is provided inside the axle box body, the positioning joint mounting seat is provided with a mounting cavity configured to mount a positioning joint, wherein a longitudinal center line of the axle box body is in parallel with a longitudinal center plane of the positioning joint mounting seat, and the longitudinal center plane of the positioning joint mounting seat is deviated outwardly with respect to a longitudinal center plane of the axle box body;

wherein the axle box body has a separated structure, comprising an upper box body and a lower box body which are in a seal fit with each other, the upper box body and the lower box body enclose to form the bearing mounting cavity, the upper box body and the lower box body are connected by bolting, and the positioning joint mounting seat and the upper box body are integrally formed; and the positioning joint mounting seat has a separated structure, which comprises a left mounting seat and a right mounting seat, the left mounting seat and the upper box body are integrally formed, each of the left mounting seat and the right mounting seat has an inwardly recessed portion, and the two recessed portions form the mounting cavity for the positioning joint after the left mounting seat and the right mounting seat are matched and fixed with each other.

2. The axle box structure for the railway vehicle according to claim 1, wherein a lower end surface of the upper box body has a convex portion extending downwardly at each of two outer lateral edges in an axial direction, an upper end surface of the lower box body has a concave portion concaved downwardly at each of two outer lateral edges in the axial direction, center portions of the upper box body and the lower box body are provided with a first semi-circular hole and a second semi-circular hole respectively, and the bearing mounting cavity is formed by the first semi-circular hole and the second semi-circular hole after the convex portion and the concave portion are assembled by covering and sealing.

3. The axle box structure for the railway vehicle according to claim 2, wherein the convex portion further has a first boss extending outwardly, the concave portion has a second boss extending outwardly, the first boss is provided with an internal threaded hole, the second boss is provided with a through hole, and the upper box body and the lower box body are fixedly connected to each other by a bolt arranged inside both the through hole and the internal threaded hole.

4. The axle box structure for the railway vehicle according to claim 3, wherein in the axial direction, each of two ends of the first boss has an extension portion extending outwardly, and each of the two extension portions is provided with a vertical damper mounting seat fitting a vertical damper of the railway vehicle.

5. The axle box structure for the railway vehicle according to claim 4, further comprising a positioning pin, wherein the positioning pin comprises a large diameter section at a middle portion and small diameter sections located at two ends of the large diameter section, a countersink is further provided in an upper end surface of the second boss, a height of the large diameter section is larger than a height of a large hole of the countersink, a positioning hole is also provided at a matching position of a lower end surface of the first boss, and the two small diameter sections are respectively arranged inside the small hole of the countersink and the positioning hole when the upper box body and the lower box body are assembled.

6. The axle box structure for the railway vehicle according to claim 3, further comprising a positioning pin, wherein the positioning pin comprises a large diameter section at a middle portion and small diameter sections located at two ends of the large diameter section, a countersink is further provided in an upper end surface of the second boss, a height of the large diameter section is larger than a height of a large hole of the countersink, a positioning hole is also provided at a matching position of a lower end surface of the first boss, and the two small diameter sections are respectively arranged inside the small hole of the countersink and the positioning hole when the upper box body and the lower box body are assembled.

7. The axle box structure for the railway vehicle according to claim 1, a wheel set hanger bracket is further provided on an outer wall of the upper box body, the wheel set hanger bracket is provided with a vertical hanging hole, and a rail guard mounting seat configured to mount and fix a rail guard of the railway vehicle is further provided at the bottom of an outer wall of the lower box body.

8. The axle box structure for the railway vehicle according to claim 1, wherein a first drainage groove and a second drainage groove are further provided in a circumferential direction of ends of end covers of the upper box body and the lower box body, and the first drainage groove and the second drainage groove form an annular groove after the upper box body and the lower box body are mounted.

9. A railway vehicle, comprising a wheel set, a frame and an axle box structure mounted between the wheel set and the frame, wherein the axle box structure is the axle box structure according to claim 1, and the frame is provided with a side beam configured to fit the positioning joint.

* * * * *